US008000829B2

(12) United States Patent
Terai

(10) Patent No.: US 8,000,829 B2
(45) Date of Patent: Aug. 16, 2011

(54) LOOP SIMULATION APPARATUS, METHOD AND PROGRAM THEREOF

(75) Inventor: Koichi Terai, Wakayama (JP)

(73) Assignee: Shima Seiki Manufacturing, Ltd., Wakayama-shi, Wakayama (JP)

( * ) Notice: Subject to any disclaimer, the term of this patent is extended or adjusted under 35 U.S.C. 154(b) by 841 days.

(21) Appl. No.: 11/996,773

(22) PCT Filed: Jul. 11, 2006

(86) PCT No.: PCT/JP2006/013780

§ 371 (c)(1),
(2), (4) Date: Jan. 25, 2008

(87) PCT Pub. No.: WO2007/013296

PCT Pub. Date: Feb. 1, 2007

(65) Prior Publication Data

US 2010/0145495 A1 Jun. 10, 2010

(30) Foreign Application Priority Data

Jul. 28, 2005 (JP) ..... 2005-219136

(51) Int. Cl.
*G06F 19/00* (2006.01)

(52) U.S. Cl. ..... 700/141

(58) Field of Classification Search ..... 700/130–133, 700/141; 66/231, 232
See application file for complete search history.

(56) References Cited

U.S. PATENT DOCUMENTS

| | | | | |
|---|---|---|---|---|
| 6,880,367 | B2 * | 4/2005 | Suzuki | 66/232 |
| 7,386,360 | B2 * | 6/2008 | Noriyuki | 700/131 |
| 2005/0039495 | A1 * | 2/2005 | Suzuki | 66/232 |
| 2007/0088453 | A1 * | 4/2007 | Noriyuki | 700/141 |

FOREIGN PATENT DOCUMENTS

| | | | |
|---|---|---|---|
| JP | 09-212664 | A | 8/1997 |
| WO | WO 2005/038117 | A1 | 4/2005 |

OTHER PUBLICATIONS

M. Meisner et al., The Art of Knitted Fabrics, Realistic & Physically Based Modelling of Knitted Patterns, Eurographics'98, vol. 17, (1998), No. 3.

* cited by examiner

*Primary Examiner* — Gary L. Welch
*Assistant Examiner* — Nathan E Durham
(74) *Attorney, Agent, or Firm* — Rothwell, Figg, Ernst & Manbeck, P.C.

(57) ABSTRACT

An apparatus, method and simulation program for performing a realistic loop simulation of a knitted fabric using empirical rules during a loop simulation while keeping the calculation load within a feasible range to express three-dimensional bulges, curls and so on of a knitted fabric.

5 Claims, 9 Drawing Sheets

52

Tension

| Connection | Pitch(cm) |
|---|---|
| 1 — 2 | 0.2 |
| 2 — 3 | 0.2 |
| ⋮ | |

80

Distortion

| Connection | Angle(rad) |
|---|---|
| 1 — 2 — 10 | 1.57 |
| 2 — 3 — 10 | 1.57 |
| ⋮ | |

81

Wale direction bending

| Connection | Angel(rad) |
|---|---|
| 1 — 10 — 20 | 3.14 |
| 2 — 11 — 21 | 3.14 |
| ⋮ | |

82

Course direction bending

| Connection | Angle(rad) |
|---|---|
| 1 — 2 — 3 | 3.14 |
| 2 — 3 — 4 | 3.14 |
| ⋮ | |

83

LOOP SIMULATION APPARATUS, METHOD AND PROGRAM THEREOF

CROSS-REFERENCE TO RELATED APPLICATION

This application is a 35 U.S.C. 371 National Phase Entry Application from PCT/JP2006/313780, filed Jul. 11, 2006, which claims the benefit of Japanese Patent Application No. 2005-219136 filed on Jul. 28, 2005, the disclosure of which is incorporated herein in its entirety by reference.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

BACKGROUND OF THE INVENTION

Field of the Invention

The present invention relates to an apparatus for performing a realistic loop simulation of a knitted fabric, a loop simulation method, and a loop simulation program.

The present applicant has proposed that a loop simulation be performed by determining the position of stitches using an empirical rule based on the type of stitch, connection relationships with adjacent stitches and so on (Japanese Unexamined Patent Application 2005-120501). However, this method is problematic in that:

- the basis for the loop simulation is dependent on an empirical rule, and therefore ambiguous, and
- it is difficult to simulate a bulging knitted fabric such as a pin tuck pattern. Furthermore, it is difficult to simulate the curl at the ends of the knitted fabric.

The latter two problems can be expressed together as difficulty in simulating the three-dimensional structure of the knitted fabric.

BRIEF SUMMARY OF THE INVENTION

The basic objects of the present invention are to minimize the use of empirical rules during a loop simulation while keeping the calculation load within a feasible range, and to express three-dimensional bulges, curls and so on of a knitted fabric.

A loop simulation apparatus according to the present invention is an apparatus for creating a knitted fabric image corresponding to design data of a knitted fabric such that a loop of each individual stitch is represented, characterized by: means for determining a distance deviation between a distance from each individual stitch on the knitted fabric image to an adjacent stitch and a standard value thereof as a tension; means for determining a deviation between an intersection angle between a line linking each individual stitch on the knitted fabric image to an adjacent stitch in a course direction and a line linking each individual stitch on the knitted fabric image to an adjacent stitch in a wale direction and a standard value thereof as a distortion angle; means for determining a deviation between an angle between two stitches adjacent to each individual stitch on the knitted fabric image in the wale direction, with respect to an axis expressing an orientation of each individual stitch on the knitted fabric image to an adjacent stitch in the course direction, and a standard value thereof as a bending angle about a course axis; means for determining a deviation between an angle between two stitches adjacent to each individual stitch on the knitted fabric image in the course direction, with respect to an axis expressing an orientation of each individual stitch on the knitted fabric image to an adjacent stitch in the wale direction, and a standard value thereof as a bending angle about a wale axis; and shifting means for shifting a position of each individual stitch on the knitted fabric image to reduce the tension, the distortion angle, the bending angle about the course axis, and the bending angle about the wale axis.

A loop simulation method according to the present invention is a method for creating a knitted fabric image corresponding to design data of a knitted fabric such that a loop of each individual stitch is represented, characterized by the steps of: determining a distance deviation between a distance from each individual stitch on the knitted fabric image to an adjacent stitch and a standard value thereof as a tension; determining a deviation between an intersection angle between a line linking each individual stitch on the knitted fabric image to an adjacent stitch in a course direction and a line linking each individual stitch on the knitted fabric image to an adjacent stitch in a wale direction and a standard value thereof as a distortion angle; determining a deviation between an angle between two stitches adjacent to each individual stitch on the knitted fabric image in the wale direction, with respect to an axis expressing an orientation of each individual stitch on the knitted fabric image to an adjacent stitch in the course direction, and a standard value thereof as a bending angle about a course axis; determining a deviation between an angle between two stitches adjacent to each individual stitch on the knitted fabric image in the course direction, with respect to an axis expressing an orientation of each individual stitch on the knitted fabric image to an adjacent stitch in the wale direction, and a standard value thereof as a bending angle about a wale axis; and shifting a position of each individual stitch on the knitted fabric image to reduce the tension, the distortion angle, the bending angle about the course axis, and the bending angle about the wale axis.

A loop simulation program according to the present invention is a program that can be executed by a computer, for creating a knitted fabric image corresponding to design data of a knitted fabric such that a loop of each individual stitch is represented, characterized by: a command for determining a distance deviation between a distance from each individual stitch on the knitted fabric image to an adjacent stitch and a standard value thereof as a tension; a command for determining a deviation between an intersection angle between a line linking each individual stitch on the knitted fabric image to an adjacent stitch in a course direction and a line linking each individual stitch on the knitted fabric image to an adjacent stitch in a wale direction and a standard value thereof as a distortion angle; a command for determining a deviation between an angle between two stitches adjacent to each individual stitch on the knitted fabric image in the wale direction, with respect to an axis expressing an orientation of each individual stitch on the knitted fabric image to an adjacent stitch in the course direction, and a standard value thereof as a bending angle about a course axis; a command for determining a deviation between an angle between two stitches adjacent to each individual stitch on the knitted fabric image in the course direction, with respect to an axis expressing an orientation of each individual stitch on the knitted fabric image to an adjacent stitch in the wale direction, and a standard value thereof as a bending angle about a wale axis; and a command for shifting a position of each individual stitch on the knitted fabric image to reduce the tension, the distortion angle, the bending angle about the course axis, and the bending angle about the wale axis.

Preferably, when shifting the stitch positions, each stitch is shifted according to a total shift amount obtained by adding together shift amounts relating respectively to the tension, the distortion angle, the bending angle about the course axis and the bending angle about the wale axis, which have been determined with respect to each stitch of the knitted fabric image.

In the following specification, unless any indication is given to the contrary, description relating to the loop simulation apparatus applies as is to the loop simulation method and loop simulation program, and description relating to the loop simulation method and loop simulation program applies as is to the loop simulation apparatus. Further, the subject knitted fabric may be a flat knitted fabric or a circular knitted fabric, and may be a piece of knitted fabric or a garment.

In the present invention, four factors determine the positions of the stitches, namely the tension, the distortion angle, the bending angle about the course axis and the bending angle about the wale axis. Note that the deviation from the standard values thereof is set as a difference, for example, but may be a ratio or the like. The tension is based on the deviation between the interval to an adjacent stitch and a standard value, and reflects a quality whereby a spring assumed to connect the stitches to each other attempts to return to its natural length (the standard value) after expanding or contracting from its natural length. The distortion angle reflects a quality whereby a stability value is allocated to the angle of each apex of a square formed by four stitches, for example, which are close to each other in the course direction and wale direction, and when the angle deviates from the stability value, it attempts to return to its original angle.

The bending angle about the course axis and the bending angle about the wale axis correspond to a quality whereby each stitch is not flat, and the two ends of the stitch attempt to move to the front and back of the knitted fabric about the center of the stitch. When the standard value of the bending angle is set at 180 degrees, the stitches attempt to converge in plane, and when the standard value is shifted from 180 degrees, the knitted fabric attempts to curl. By employing the bending angle about the course axis and the bending angle about the wale axis, the manner in which the knitted fabric deviates from the plane and deforms three-dimensionally can be simulated.

The four factors described above are based on various forces acting on the stitches and the force exerted by the stitches themselves as they attempt to deform three-dimensionally, and are not simply modelizations of an empirical rule. Hence, a loop simulation based on a well-founded model can be performed. Furthermore, to perform a simulation using the model described above, it is only necessary to determine the tension, the distortion angle, and the bending angles bout the course axis and wale axis, and these factors are all amounts that can be calculated simply. Hence, the time required for the simulation can be held within a practical range. In the present invention, a virtual knitted fabric or garment obtained through a loop simulation of knitting data can be viewed as if placed on a flat surface, for example, and therefore the knitted fabric or garment can be evaluated without test knitting.

The stitches may be shifted every time the tension, distortion angle, and bending angles about the course axis and wale axis are determined, but in so doing, the positional relationships between the stitches vary while the deviations are determined. Therefore, it is easier to determine the tension, distortion angle, and bending angles about the course axis and wale axis for all of the stitches, for example, and then perform processing to shift each stitch in accordance with a total shift amount obtained by adding together the respective shift amounts of the tension, distortion angle, and bending angles about the course axis and wale axis.

Figure 1:
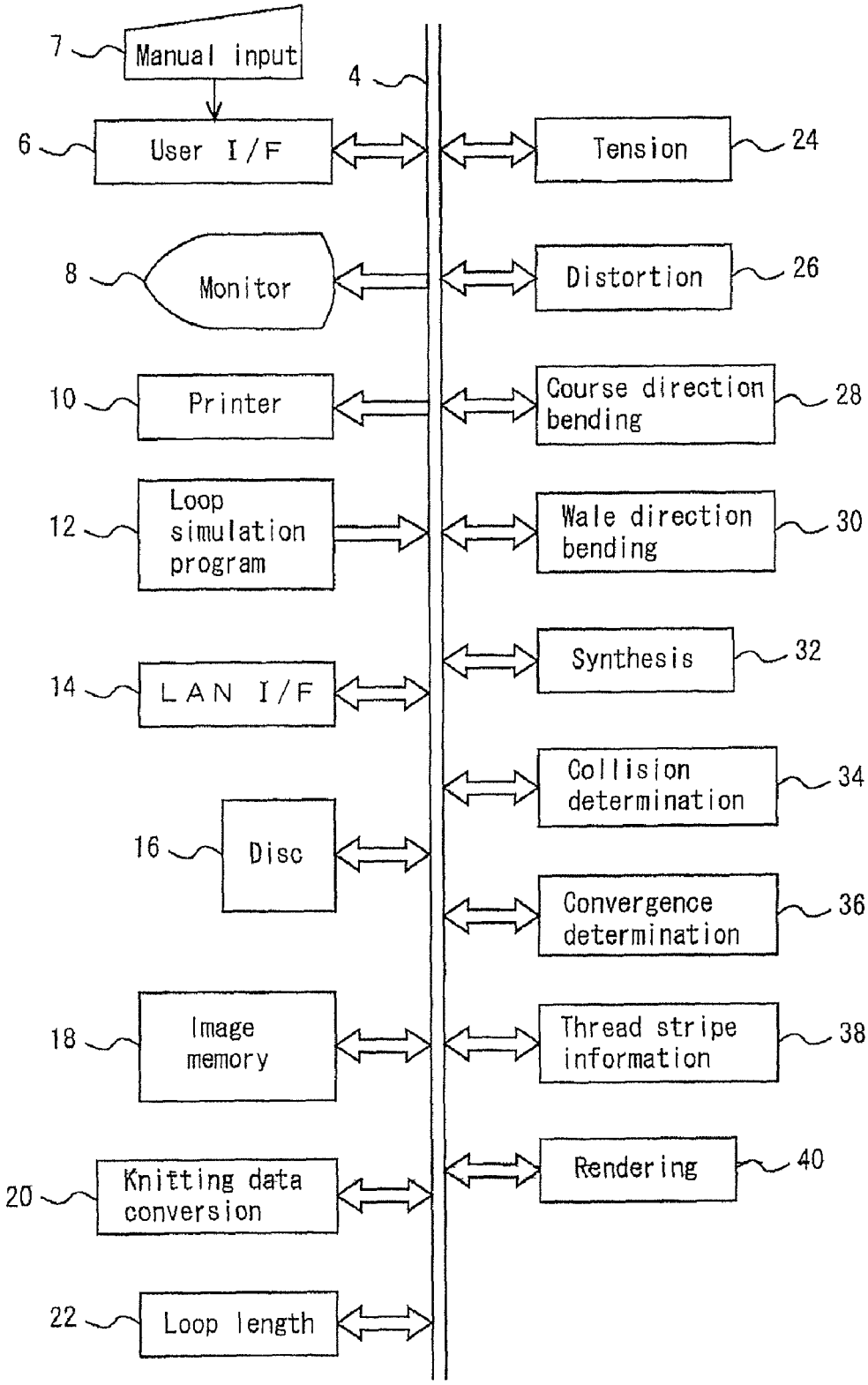
FIG. 1 is a block diagram of a loop simulation apparatus according to an embodiment.

The reference symbols in the drawings are described as follows:

2 loop simulation apparatus
4 bus
6 user interface
7 manual input
8 monitor
10 printer
12 loop simulation program storage unit
14 LAN interface
16 disk drive
18 image memory
20 knitting data converter
22 loop length processor
24 tension processor
26 distortion processor
28 course direction bending processor
30 wale direction bending processor
32 synthesizer
34 collision determination unit
36 convergence determination unit
38 thread stripe information creation unit
40 rendering unit
52 loop simulation program
54 tension processing command
56 distortion processing command
58 course direction bending processing command

60 wale direction bending processing command
62 synthesis command
64 collision determination command
66 convergence determination command
68 thread stripe information creation command
70 rendering command
80-83 parameter lists
90 stitch model
91 stitch position
92-95 knitted fabric models
P0 stitch position
P1-P4 peripheral stitch positions
Axis axis
θ, ϕ default values of bending angles

DETAILED DESCRIPTION OF THE INVENTION

A best mode for carrying out the present invention will be described below.

FIGS. 1 to 13 show an embodiment. In the drawings, 2 denotes a loop simulation apparatus, 4 denotes a bus for data, commands and so on, 6 denotes a user interface for inputting a knitted fabric design through manual input 7 using a stylus, a mouse, a track ball, a keyboard or similar. Further, the loop length of a stitch, the material of the thread, the shrinkage factor during finishing and so on are input into the user interface 6 from the manual input 7, as well as a standard value of the intersection angle between the course direction and the wale direction, or more precisely a standard value of an intersection angle between a line linking a subject stitch and an adjacent stitch in the course direction and a line linking the subject stitch and an adjacent stitch in the wale direction. Further, a standard value of an angle between two stitches on either side of an axis relating to a course direction axis, a standard value of an angle between two stitches on either side of an axis relating to a wale direction axis and so on are also input. The loop length, the thread material, the shrinkage factor during finishing, the standard value of the intersection angle, the standard values of the angles between stitches on either side of the axes and so on serve as simulation parameters.

8 denotes a display on which design data, loop simulation images of a knitted fabric and so on are displayed, while a printer 10 also outputs the knitted fabric design data, loop simulation images and so on. Note that a loop simulation image is an image simulating a virtual knitted fabric based on the design data of a knitted fabric such that individual loops (stitches) are represented realistically. The individual stitches have in-plane coordinates (x, y) and a coordinate (z coordinate) in an orthogonal direction to the in-plane coordinates, and the position of the stitch is represented by the base position of the stitch.

Figure 2:
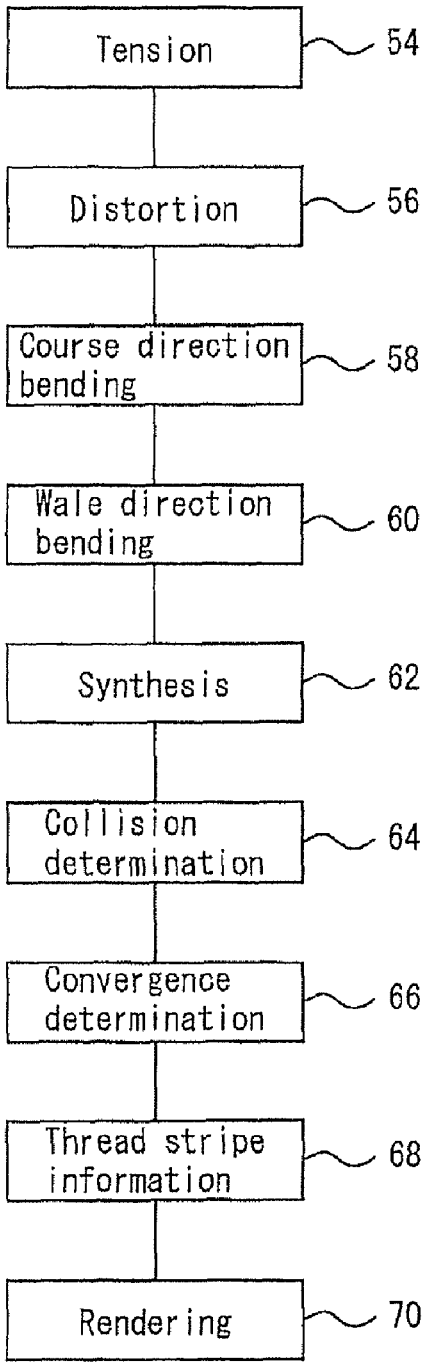
FIG. 2 is a block diagram of a loop simulation program according to this embodiment.

12 denotes a loop simulation program storage unit storing a program required to perform a loop simulation. FIG. 2 shows the program in detail. 14 is a LAN interface for inputting and outputting the knitted fabric loop simulation program, design data, knitting data based on the design data of the knitted fabric, loop simulation images and so on to and from a LAN. A disk drive 16 inputs and outputs data to and from a disk in a similar fashion to the LAN interface 14. 18 denotes image memory storing images such as loop simulation images in a raster format, for example. 20 is a knitting data converter for converting knitted fabric data designed on the user interface 6 or the like into knitting data that can be knitted on a flatbed knitting machine. 22 is a loop length processor for outputting the loop length of individual stitches in accordance with the knitting data.

24 is a tension processor for outputting a difference between a distance from each individual stitch to four adjacent stitches in the wale direction and course direction, for example, and a default value, or in other words a standard value, as the tension. This tension value expresses tension generated when the distance between stitches deviates from the standard value. Note that in the following description, the term "adjacent stitches" signifies adjacent stitches in the wale direction and course direction, and when a right side stitch in the course direction or the like is being referred to, the terms "the adjacent right side stitch in the course direction" and so on will be used. In this embodiment, only the relationships between adjacent stitches are dealt with.

Further, the default value is determined here according to the loop length, and may signify the length of the thread per loop prior to stretching at the tension generated during knitting on a knitting machine, the length of the thread per loop during stretching at the tension of the knitting machine, or the length of the thread per loop following shrinkage when finishing is performed after the knitting is complete. The loop length may be assumed to vary in predetermined sections or in each individual stitch. The expansion and contraction of the thread at the tension of the knitting machine and during finishing depends on the material of the thread, and therefore the type of thread is also input into the user interface 6.

A distortion processor 26 determines the angle of a triangle constituted by a single stitch adjacent to each individual stitch in the wale direction, a single stitch adjacent to each individual stitch in the course direction, and the subject stitch, or in other words an intersection angle. When the course direction and wale direction form a right angle, this angle, i.e. the intersection angle, should be 90 degrees. A standard value (default value) of the intersection angle is set at 90 degrees unless input indicating otherwise is received through the user interface 6. The difference between the intersection angle and the standard value is the distortion angle, and each individual stitch has four intersection angles. Here, however, the intersection angle between the left side adjacent stitch in the course direction and one of the upper and lower stitches in the wale direction and the intersection angle between the right side stitch in the course direction and the aforementioned stitch in the wale direction are used, and therefore two intersection angles are determined for each individual stitch. A force for aligning the intersection angle with the default value acts on the adjacent stitch in accordance with the difference between the intersection angle and the default value, or in other words the distortion angle. The distortion angle expresses this force.

A course direction bending processor 28 is based on the fact that, with respect to the axis of the course direction, the two adjacent stitches in the wale direction become stable at a predetermined angle. Further, a wale direction bending processor 30 is based on the fact that, with respect to the axis of the wale direction, the two adjacent stitches in the course direction become stable at a predetermined angle. These processors 28, 30 will be described in detail below with reference to FIG. 8.

A synthesizer 32 shifts the individual stitches over the knitted fabric data. The positions of the stitches may be moved every time the tension, the distortion angle, and the bending angles about the course axis and wale axis are determined, but in this embodiment, the tension, the distortion angle and the bending angles about the course axis and wale axis are calculated in relation to all of the stitches. A weighting is then applied to these elements such that when the weighting of the tension is 1, for example, the other weightings are between approximately 1 and 0.1. The weighting is multiplied by each element, such as the tension, and the result is set as an individual shift amount. In the case of the tension, for example, four adjacent stitches exist as standard in the course direction and wale direction, and therefore four tension values are obtained. Hence, by multiplying a weighting by these values and then adding the results together, a total shift amount is generated in relation to the tension. In this manner, a total shift amount relating to the four factors described above is determined. The other shift amounts, such as the distortion angle, likewise include a plurality of elements per shift amount.

The total shift amount is determined for each individual stitch, whereupon the stitches are shifted. The shift amount includes the amount by which the subject stitch is moved and the amount by which adjacent stitches are moved. Note that if an attempt is made to shift a single stitch and its adjacent stitches every time the total shift amount relating to the stitch is determined and then determine the shift amount of the next stitch, calculation of the shift amount becomes unstable.

A collision determination unit 34 detects collisions between stitches such that when the positions of two stitches match in a horizontal plane, for example, and there is no difference in the diameter part of the thread on the z coordinate of the stitches, it is determined that a collision has occurred. When the collision determination unit 34 detects a collision, the shift amount is changed to a position at which the collision does not occur.

A convergence determination unit 36 determines whether or not the shift amount has converged to 0 or to a predetermined value or less when a process extending from calculation of the shift amount to correction of the shift amount through collision determination has been executed repeatedly. When the shift amount has converged or the number of processes has reached an upper limit, the convergence determination unit 36 terminates stitch position shifting, assuming that stable knitted fabric data have been obtained in relation to the four factors described above through simulation.

A thread stripe information creation unit 38 determines the thread stripe, i.e. the position of the thread or the flow of the thread, such that the determined stitch positions are connected. As a result, the thread position is determined. On the basis of this position, a rendering unit 40 implements rendering, and thus a loop simulation image is obtained.

FIG. 2 shows an outline of a loop simulation program 52. This program is used to execute the loop simulation of this embodiment on a dedicated knit design apparatus, a personal computer, or similar. A tension processing command 54 is a command for mounting the tension processor 24, and the content of the command is similar to the processing performed by the tension processor 24. A distortion processing command 56 is a command for executing the processing of the distortion processor 26. A course direction bending processing command 58 is a command for executing the processing of the course direction bending processor 28. A wale direction bending processing command 60 is a command for executing the processing of the wale direction bending processor 30.

A synthesis command 62 is a command for executing the processing of the synthesizer 32. A collision determination command 64 is a command for executing the processing of the collision determination unit 34. A convergence determination command 66 is a command for executing the processing of the convergence determination unit 36. A thread stripe information creation command 68 is a command for executing the processing of the thread stripe information creation unit 38. A rendering command 70 is a command for executing the processing of the rendering unit 40.

Figure 3:
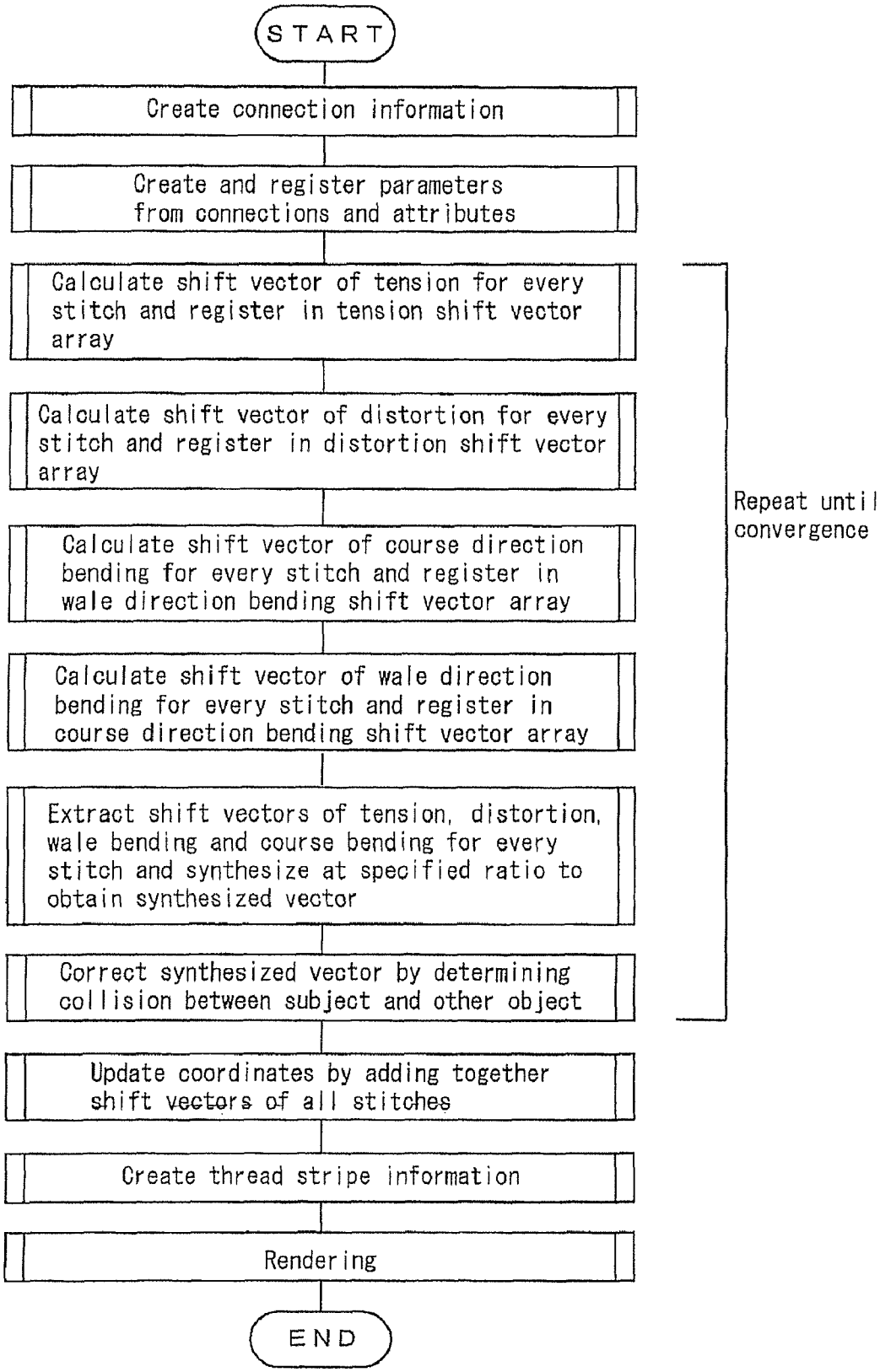
FIG. 3 is a flowchart showing a loop simulation algorithm according to this embodiment.

FIG. 3 shows an algorithm of a loop simulation method according to this embodiment. The algorithm executes the operation of the apparatus 2 shown in FIG. 1 unless otherwise specified. Connection relationships (connection information) between each stitch and its adjacent stitches are determined from the knitting data, and the characteristics of the individual stitches, such as the stitch type (knit, tuck, miss), knit stitch, purl stitch, double stitch, racking amount and end stitch are determined from the connection information and registered as attributes. In addition, the loop length and so on are determined from the knitting data and added to the attributes. From the connection information and the attributes, the standard default values of the tension, distortion angle, course direction bending angle and wale direction bending angle are determined, and when specific input is provided in relation to these factors through the user interface 6, the default values are set accordingly.

Respective shift amounts, i.e. shift vectors or correction vectors, are determined in relation to the tension, distortion angle and bending angles and gradually added to a shift vector array. This array is a data array, the individual elements of which are the respective shift amounts of the tension, distortion angle, wale direction bending angle and course direction bending angle of each stitch.

In parameter lists 80 to 83 shown in FIG. 4, numerals such as 1, 2, 3 provided below the teen "connection" indicate stitch numbers. The angle unit is radians, in which the default values relating to the four elements are expressed. Here, the default value of the distortion, i.e. the distortion angle, is 90 degrees (1.57 rad), but may take a value other than 90 degrees. Further, when the default values of the wale direction bending angle and course direction bending angle deviate from 180 degrees (3.14 rad), the curl at the ends of the knitted fabric and the bulge of the knitted fabric can be expressed three-dimensionally. Note that similar lists are created in relation to the position of each stitch on the knitted fabric data, and the tension, distortion angle, course direction bending angle and wale direction bending angle are determined from the differences between the lists.

The shift amounts (shift vectors) of each of the tension, the distortion angle, the wale direction bending angle and the course direction bending angle are extracted from the array, multiplied by the weighting of each factor, and added together to produce a synthesized shift vector. Next, the presence of a collision between the subject stitch (each stitch) and the other stitches when each stitch is moved by the synthesized shift vector is determined, and when a collision occurs, the synthesized vector is corrected so as to avoid the collision.

The positions of all of the stitches, i.e. all of the stitches of the knitted fabric, are then shifted in accordance with the synthesized vector. When the stitch shift amount of a single process converges to substantially zero, thread stripe information is created using the position and attributes of the stitch and the position of adjacent stitches, whereupon rendering is performed to create a realistic loop simulation image.

Figures 4, 5:
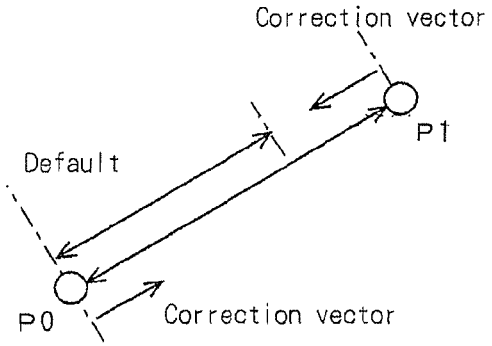
FIG. 4 is a view showing examples of parameter lists according to this embodiment.
FIG. 5 is a view showing tension processing according to this embodiment.

FIG. 5 shows processing relating to the tension. Note that in the following description, P0 denotes the subject stitch, and P1 to P4 denote adjacent stitches. The distance between P0 and P1 is determined and compared with the default value. The difference between the distance and the default value is then halved, and the result is set as the correction vector (tension) of the positions of the stitches P0, P1. Typically, the stitch P0 has approximately four adjacent stitches, and therefore this processing is performed on each adjacent stitch. This is based on a model whereby each stitch is assumed to be connected by a spring and the natural length of the spring serves as the default value.

Figure 6:
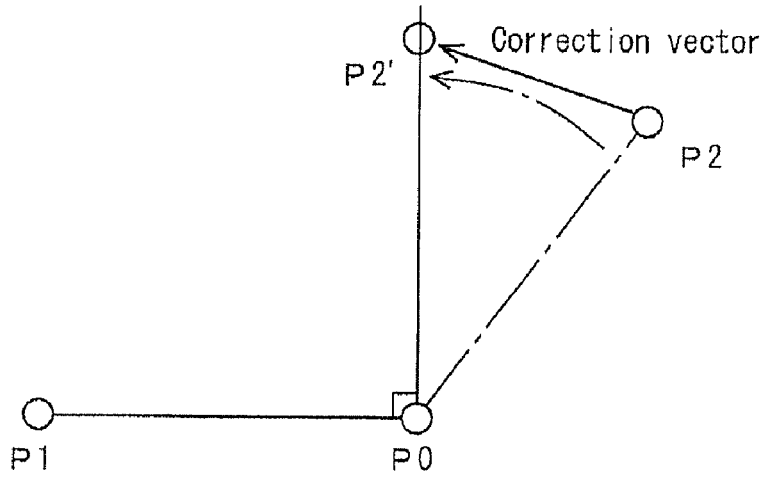
FIG. 6 is a view showing distortion processing of a right side stitch according to this embodiment.
Figure 7:
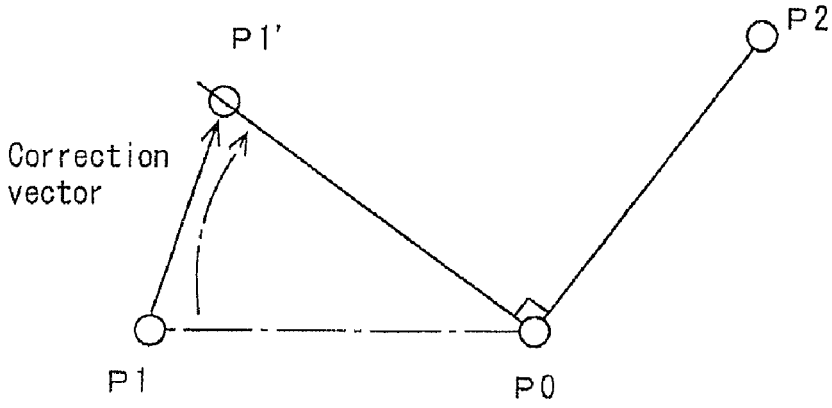
FIG. 7 is a view showing distortion processing of a left side stitch according to this embodiment.

FIGS. 6 and 7 show processing relating to the distortion angle. Here, the default value of the intersection angle is indicated to be 90 degrees, and a perpendicular axis to a plane including the three points of the stitches P0, P1 and P2 is set as a rotary axis. This axis is not necessarily perpendicular to the plane of the entire knitted fabric. The difference between the angle P1-P0-P2 and its default value is determined and set as the distortion angle, and the distortion angle is set as the correction vector relating to the stitches P1 and P2. Although the correction vector appears to be too large, a weighting is multiplied by the correction vector when determining the synthesized shift vector, and therefore it does not matter here whether or not the correction vector is too large.

Figure 8:
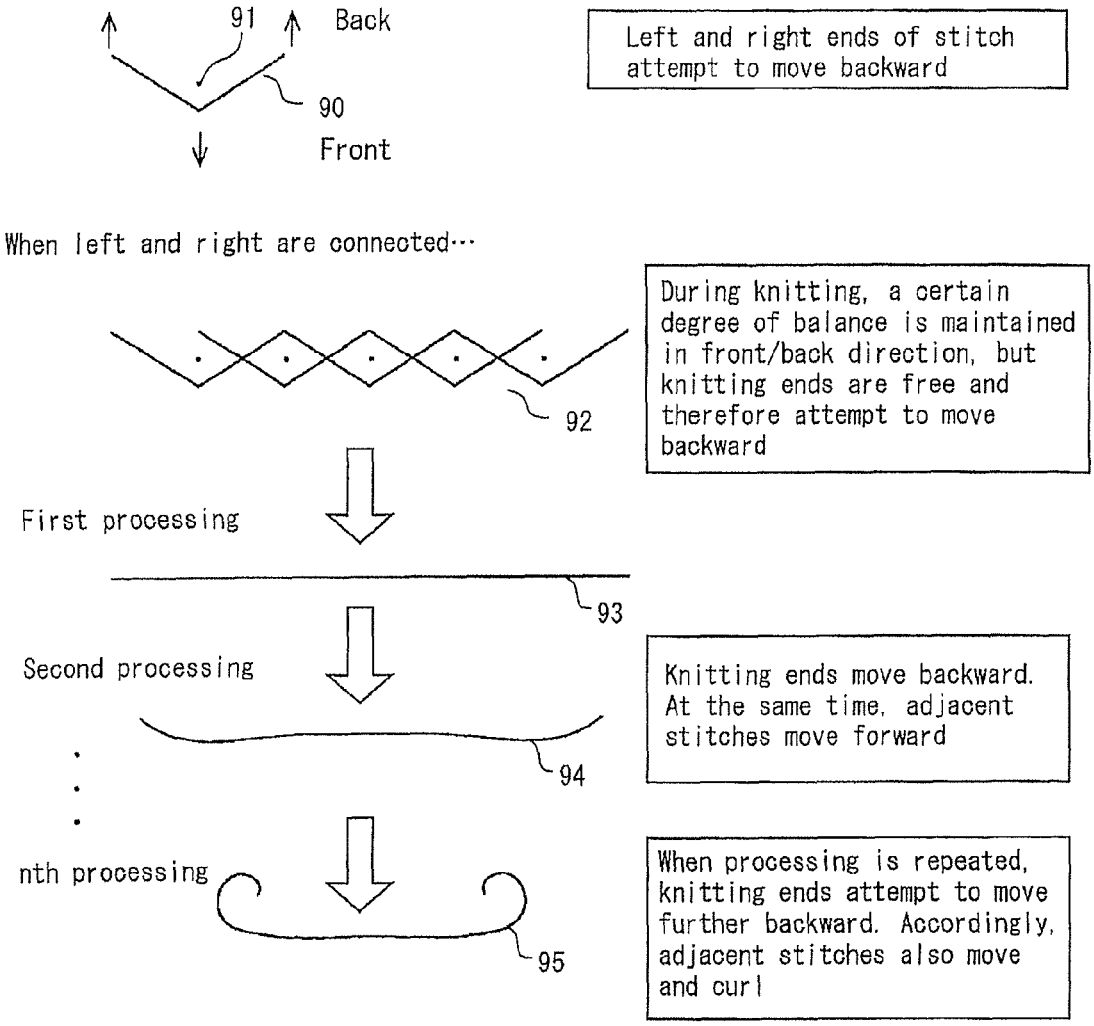
FIG. 8 is a view showing a model of a curl at the end of a knitted fabric.

FIG. 8 shows a model of the curl of the knitted fabric. 90 denotes a stitch model, and 91 denotes a stitch position of the stitch. The drawing shows a plain face stitch, or knitted fabric models 92 to 95 constituted only by plain face stitches, from above. The lower side of the drawing corresponds to the front and the upper side corresponds to the back. In a plain face stitch, the center of the stitch tends to be pulled forward while the left and right ends tend to be pulled back. On a plain fabric formed by plain face stitch, the front-back pulling force is balanced in the center of the knitted fabric, or in other words during knitting, but since the knitted ends, i.e. the ends of the knitted fabric, are free, these knitted ends are pulled back. On an actual knitted fabric, the left and right ends of a plain fabric formed by plain face stitch curl backward due to this mechanism. Wale direction bending processing serves as processing corresponding to this phenomenon, and by repeating this processing, the left and right ends curl backward, as can be seen from the knitted fabric model 93 to the knitted fabric model 95. Wale direction bending processing is processing for simulating bending in the knitted fabric about the wale direction, and the subject of the processing is not limited to the curl at either end of the knitted fabric.

A similar problem occurs as curling at the top and bottom of the knitted fabric, and when a plain face stitch is observed from the side, the two ends of the stitch are pulled forward and the center of the stitch is pulled backward. The upper end and lower end of the knitted fabric are free, and therefore forward direction curling occurs in these positions. This phenomenon is simulated by course direction bending processing, whereby bending displacement of the knitted fabric relating to the course direction axis is simulated.

Figure 9:
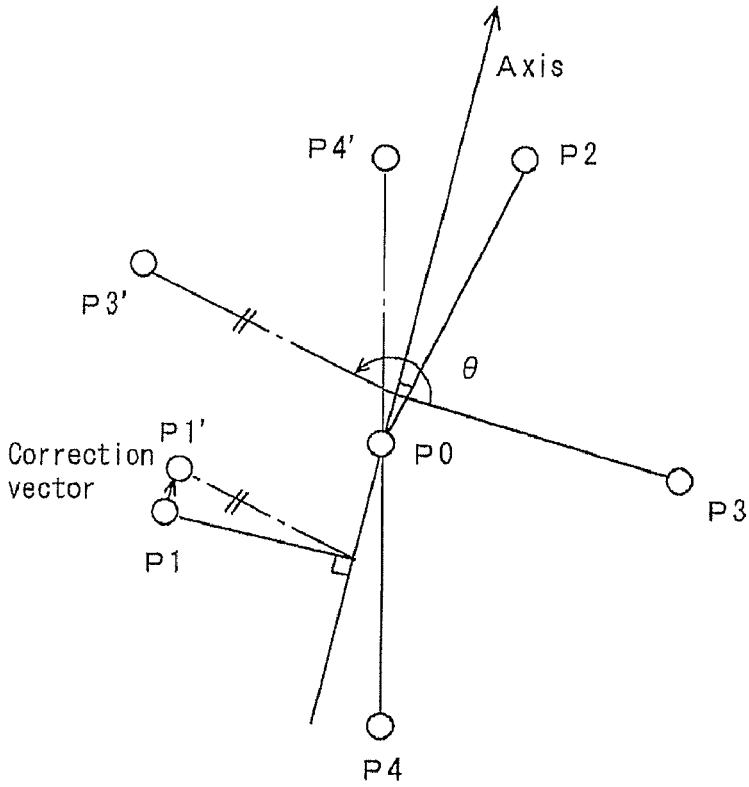
FIG. 9 is a view showing wale direction bending processing performed on a left side stitch according to this embodiment.

FIG. 9 shows wale direction bending processing relating to the left side stitch P1. A rotary axis Axis is generated using the stitches P2, P4 on the upper and lower sides of the subject stitch P0 in the wale direction. More specifically, a symmetrical position P4' to the stitch P0 is determined in relation to the lower side stitch P4, and the axis Axis is generated in an intermediate orientation between a vector POP2 and a vector POP4'. A position obtained by rotating the stitch P3 about the axis Axis by an amount corresponding to a bending angle default value θ is set as P3'. A position obtained by shifting the stitch P1 to a position parallel to a vector approaching the position P3' from the axis Axis that passes through the stitch P1 on a spherical surface having the foot of a perpendicular line to the axis as its center is set as P1'. The vector from P1 to P1' is set as the correction vector. The processing in FIG. 9 is processing for aligning the angle formed by the stitch P1 and the stitch P3 relative to the axis Axis with the bending angle default value θ. In consideration of the fact that the left and right sides of the stitch are pulled backward in the stitch model 90 shown in FIG. 8, the bending angle θ is set at approximately 120 degrees, for example, but in the center of the knitted fabric, θ may be set at approximately 180 degrees.

Figure 10:
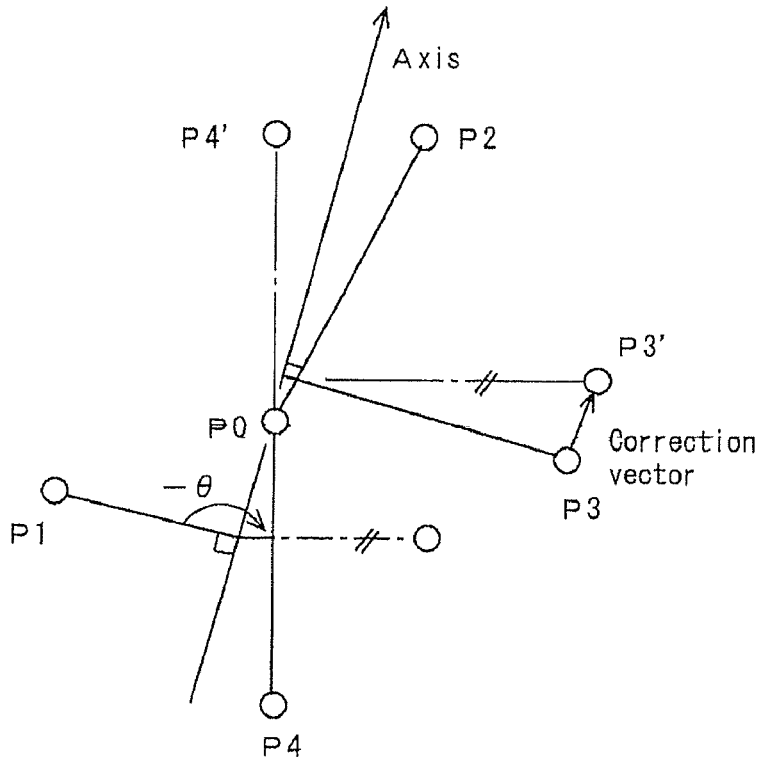
FIG. 10 is a view showing wale direction bending processing performed on a right side stitch according to this embodiment.

FIG. 10 shows the determination of a correction vector relating to the stitch P3. The content of the processing is similar to that of FIG. 9. In other words, a correction vector is generated in relation to the axis Axis in order to align the angle formed by the stitch P1 and the stitch P3 with θ.

Figure 11:
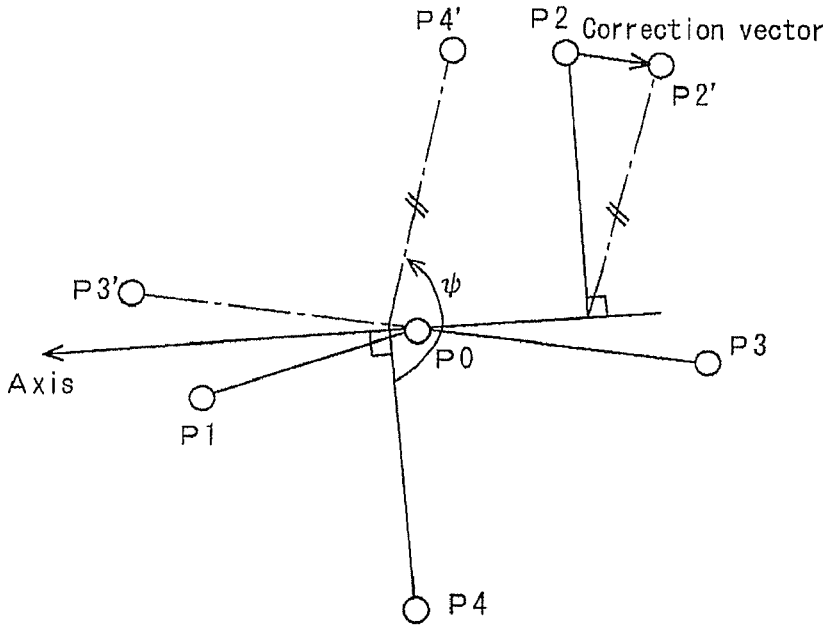
FIG. 11 is a view showing course direction bending processing performed on an upper side stitch according to this embodiment.
Figure 12:
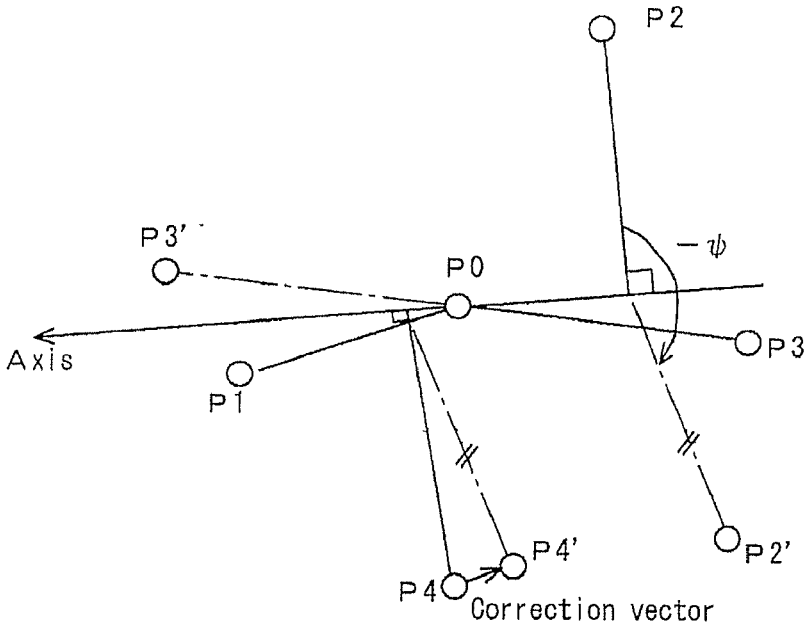
FIG. 12 is a view showing course direction bending processing performed on a lower side stitch according to this embodiment.

FIGS. 11 and 12 show processing of the course direction bending angle, in which the processing model is similar to that of FIG. 9. A symmetrical point to the stitch P3 is set as P3' in relation to the subject stitch P0, whereupon the stitch P1 and the stitch P3' are used to generate the axis Axis. Next, a point obtained by rotating the stitch P4 by an amount corresponding to the default value ϕ of the course direction bending angle is set as P4', whereupon a correction vector is generated at an identical distance from the axis Axis to the stitch P2 and at an identical orientation from the axis to P4'.

In FIG. 12, a similar axis Axis is generated, whereupon a point P2' is generated by rotating the stitch P2 by an amount corresponding to −ϕ about the axis. The correction vector is then generated at an identical distance from the axis to the stitch P4 and at an identical orientation from the axis to P2'.

Figure 13:
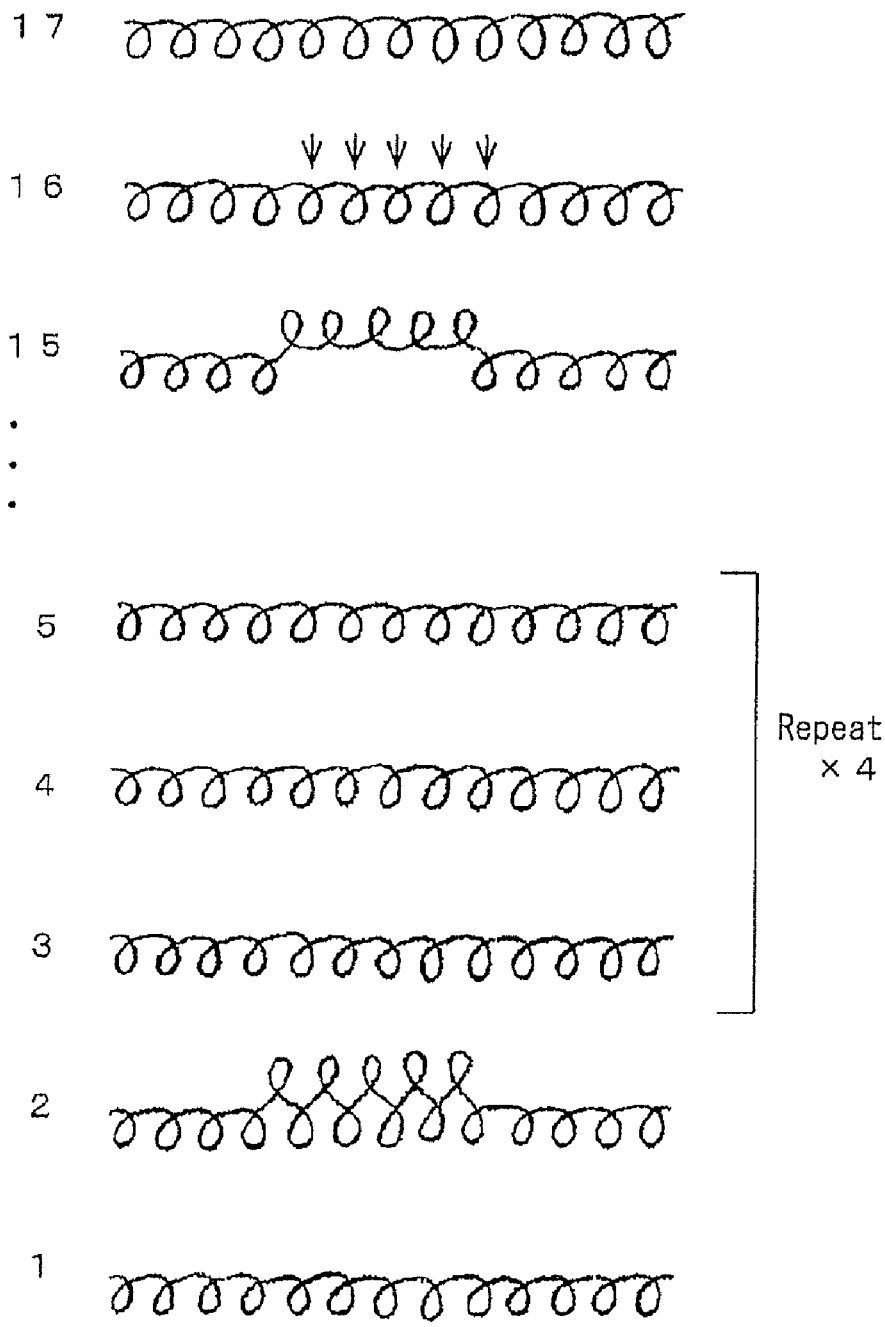
FIG. 13 is a view showing a pin tuck knitting procedure.

FIG. 13 shows a knitting procedure for a pin tuck pattern. A rib knit part is present in the center of the knitted fabric in FIG. 17, and in this part, the number of knit stitches is far greater than the number of purl stitches. As a result, the knitted fabric bulges to the front side.

A pattern can be made to stand out by varying the size of each stitch using black and white thread. In this embodiment, a simulation can be performed such that the stitch size is modified according to the loop length of each stitch, and therefore this type of pattern can also be simulated.

In a simulation image of a glove, which relates to a tubular knitted fabric having a back side and a palm side, the default value of the course direction and wale direction bending angles is set at 120 degrees such that the bend at the ends of the tubular glove are represented naturally.

In one embodiment, a simulation of a knitting pattern for a pin tuck pattern can be produced where the three-dimensional deformation of the knitted fabric caused by the pin tuck is represented. The pin tuck is represented with a tendency to be pushed toward the lower side of the knitted fabric, but a simulation that emphasizes the bulging and projection of the pin tuck from the knitted fabric may also be performed.

The invention claimed is:

1. A loop simulation apparatus comprising a computer processor for creating a knitted fabric image corresponding to design data of a knitted fabric such that a loop of each individual stitch is represented comprising:

means for determining a distance deviation between a distance from each individual stitch on said knitted fabric image to an adjacent stitch and a standard value thereof as a tension;

means for determining a deviation between an intersection angle between a line linking each individual stitch on said knitted fabric image to an adjacent stitch in a course direction and a line linking each individual stitch on said knitted fabric image to an adjacent stitch in a wale direction and a standard value thereof as a distortion angle;

means for determining a deviation between an angle between two stitches adjacent to each individual stitch on said knitted fabric image in said wale direction, with respect to an axis expressing an orientation of each individual stitch on said knitted fabric image to an adjacent stitch in said course direction, and a standard value thereof as a bending angle about a course axis;

means for determining a deviation between an angle between two stitches adjacent to each individual stitch on said knitted fabric image in said course direction, with respect to an axis expressing an orientation of each individual stitch on said knitted fabric image to an adjacent stitch in said wale direction, and a standard value thereof as a bending angle about a wale axis; and shifting means for shifting a position of each individual stitch on said knitted fabric image to reduce said tension, said distortion angle, said bending angle about said course axis, and said bending angle about said wale axis.

2. The loop simulation apparatus according to claim 1, characterized in that in said shifting means, each stitch is shifted according to a total shift amount obtained by adding together shift amounts relating respectively to said tension, said distortion angle, said bending angle about said course axis and said bending angle about said wale axis, being determined with respect to each stitch of said knitted fabric image.

3. A loop simulation method for creating a knitted fabric image corresponding to design data of a knitted fabric such that a loop of each individual stitch is represented, comprising providing a computer configured to execute the following steps:

determining a distance deviation between a distance from each individual stitch on said knitted fabric image to an adjacent stitch and a standard value thereof as a tension;

determining a deviation between an intersection angle between a line linking each individual stitch on said knitted fabric image to an adjacent stitch in a course direction and a line linking each individual stitch on said knitted fabric image to an adjacent stitch in a wale direction and a standard value thereof as a distortion angle;

determining a deviation between an angle between two stitches adjacent to each individual stitch on said knitted fabric image in said wale direction, with respect to an axis expressing an orientation of each individual stitch on said knitted fabric image to an adjacent stitch in said course direction, and a standard value thereof as a bending angle about a course axis;

determining a deviation between an angle between two stitches adjacent to each individual stitch on said knitted fabric image in said course direction, with respect to an axis expressing an orientation of each individual stitch on said knitted fabric image to an adjacent stitch in said wale direction, and a standard value thereof as a bending angle about a wale axis; and shifting a position of each individual stitch on said knitted fabric image to reduce said tension, said distortion angle, said bending angle about said course axis, and said bending angle about said wale axis.

4. The loop simulation method according to claim 3, characterized in that, when shifting said stitch positions, each stitch is shifted according to a total shift amount obtained by adding together shift amounts relating respectively to said tension, said distortion angle, said bending angle about said course axis and said bending angle about said wale axis, being determined with respect to each stitch of said knitted fabric image.

5. A loop simulation program for creating a knitted fabric image corresponding to design data of a knitted fabric such that a loop of each individual stitch is represented embodied on a non-transitory computer-readable medium that when executed by a computer causes the computer to perform the steps of:

determining a distance deviation between a distance from each individual stitch on said knitted fabric image to an adjacent stitch and a standard value thereof as a tension;

determining a deviation between an intersection angle between a line linking each individual stitch on said knitted fabric image to an adjacent stitch in a course direction and a line linking each individual stitch on said knitted fabric image to an adjacent stitch in a wale direction and a standard value thereof as a distortion angle;

determining a deviation between an angle between two stitches adjacent to each individual stitch on said knitted fabric image in said wale direction, with respect to an axis expressing an orientation of each individual stitch on said knitted fabric image to an adjacent stitch in said course direction, and a standard value thereof as a bending angle about a course axis;

determining a deviation between an angle between two stitches adjacent to each individual stitch on said knitted fabric image in said course direction, with respect to an axis expressing an orientation of each individual stitch on said knitted fabric image to an adjacent stitch in said wale direction, and a standard value thereof as a bending angle about a wale axis; and shifting a position of each individual stitch on said knitted fabric image to reduce said tension, said distortion angle, said bending angle about said course axis, and said bending angle about said wale axis.

* * * * *

UNITED STATES PATENT AND TRADEMARK OFFICE

CERTIFICATE OF CORRECTION

PATENT NO. : 8,000,829 B2
APPLICATION NO. : 11/996773
DATED : August 16, 2011
INVENTOR(S) : Terai It is certified that error appears in the above-identified patent and that said Letters Patent is hereby corrected as shown below:

Title page, item (86) insert the following:
PCT No.: PCT/JP2006/313780

Signed and Sealed this
Twentieth Day of December, 2011

David J. Kappos

David J. Kappos
*Director of the United States Patent and Trademark Office*